US006016734A

United States Patent [19]

Koch

[11] Patent Number: 6,016,734

[45] Date of Patent: Jan. 25, 2000

[54] COLD MEAT SLICING MACHINE

[76] Inventor: Klaus Koch, Grabenstrasse 25, D-72351 Geislingen, Germany

[21] Appl. No.: 08/793,236

[22] PCT Filed: Jun. 28, 1995

[86] PCT No.: PCT/EP95/02509

§ 371 Date: Feb. 20, 1997

§ 102(e) Date: Feb. 20, 1997

[87] PCT Pub. No.: WO96/05952

PCT Pub. Date: Feb. 29, 1996

[30] Foreign Application Priority Data

Aug. 20, 1994 [DE] Germany ..... 44 29 628

[51] Int. Cl.[7] ..... B26D 7/22

[52] U.S. Cl. ..... 83/707; 83/468.7; 83/932; 83/DIG. 1

[58] Field of Search ..... 83/703, 707, 932, 83/DIG. 1, 399, 400, 467.1, 468.6, 468.7, 713–731

[56] References Cited

U.S. PATENT DOCUMENTS 4,541,319 9/1985 Maurer et al. ..... 83/DIG. 1 X 5,615,591 4/1997 Scherch et al. ..... 83/399

5,687,626 11/1997 Scherch et al. ..... 83/932 X

FOREIGN PATENT DOCUMENTS 0503168 9/1992 European Pat. Off. .

9109895 2/1992 Germany .

2090122 7/1982 United Kingdom .

*Primary Examiner*—Clark F. Dexter

*Attorney, Agent, or Firm*—Shenier & O'Connor

[57] ABSTRACT

A food slicing machine including a housing and a disc-shaped knife which is mounted for rotation on the housing. An adjusting device moves a stop plate relative to the cutting plane of the knife to set the slice thickness. A food carriage reciprocates adjacent the knife and is pivotable between a slice cutting position and a fully retracted position. A locking disc is connected to the adjusting device and includes a slot of uniform width extending from the periphery in a generally radial direction. A locking element which is slightly smaller than the slot is arranged to enter the slot responsive to pivoting of the carriage out of the slice cutting position. Upon setting the adjusting device to a slice thickness of zero, the slot is aligned with the locking element. A relatively small amount of pivoting of the carriage from the slice cutting position toward the fully retracted position causes the locking element to enter the slot and prevent substantial rotation of the adjusting device in either direction.

13 Claims, 3 Drawing Sheets

COLD MEAT SLICING MACHINE

This application is a continuation of co-pending International Application PCT/EP95/02509 (WO 96/05952) filed on Jun. 28, 1995, status pending.

The present disclosure relates to the subject matter disclosed in International Application No. PCT/EP95/02509 (WO 96/05952) filed Jun. 28, 1995, the entire specification of which is incorporated herein by reference.

The invention relates to a cold meat slicing machine, in particular for slicing foods, comprising a machine housing, a driven circular knife mounted thereon, a stop plate adjustable by means of an adjusting device for setting the cold meat slice thickness relative to the cutting plane of the circular knife, a carriage held on the machine housing for displacement back and forth along a guide means extending parallel to the cutting plane and a locking device, which comprises a locking disk coupled to the adjusting device and a locking element which is adapted to engage in a recess at the circumference of the locking disk and which can be actuated and engaged in the recess of the locking disk when the carriage is pivoted out of its working position, wherein the locking disk takes up a position in relation to the locking element which prevents any engagement of the locking element in the recess and thus any pivoting of the carriage when the stop plate is set by means of the adjusting device to a slick thickness greater than zero, and wherein any adjustment of the stop plate is blocked by the locking element engaged in the recess of the locking disk when the carriage is pivoted out of its working position.

In the case of cold meat slicing machines of this type, injuries caused by the operator cutting himself/herself on the circular knife, above all during the cleaning of the machine, during which the carriage must be pivoted out of its working position into a position out of operation, are intended to be excluded as far as possible.

It is known to protect the cutting edge of the circular knife at the circumference with an annular, stationary knife protection ring against any contact, wherein the cutting area is left free. This area is covered by the stop plate of the product to be cut in the slice thickness setting "zero". During the cleaning of the machine, the carriage is pivoted away from the knife and the stop plate is thereby locked in the slice thickness setting "zero".

EP 0 530 168 A1 describes a locking device of this type. With the pivoting away movement of the carriage a slide connected to the carriage base is moved translatorily and this actuates a locking bar, the rounded locking element of which gradually dips in a circular arc into a rounded recess of the slice thickness adjusting device which is arranged along the circular circumference of the locking disk and locks it. As a result of the direction of movement and the shape of the locking element, the locking of the stop plate does not become effective until the carriage has pivoted through a larger angle. This is worsened by the unfavorable connection of the carriage with the slide and of the slide with the locking bar which are respectively connected by means of a slot guide means and a bolt stub engaging therein. The conversion of the rotatory movement of the carriage base into a translatory movement of the slide and the additional conversion into the rotational movement of the locking bar results in an undefinable bearing play in combination with the slot guide means. An additional disadvantage is the fact that following the pivoting of the carriage back into the working or cutting position and the subsequent cutting stroke movement the slide/locking bar connection is disengaged from one another, whereby the slice thickness adjusting device can be rotated into an uncontrolled position and the locking no longer functions.

The object underlying the invention is to provide a simple, mechanical locking means for the slice thickness adjusting device which already ensures a reliable locking function shortly after commencement of the pivoting away movement of the carriage.

This object is accomplished in accordance with the invention, in the cold meat slicing machine described at the outset, in that the recess of the locking disk is a groove extending from the circumference of the disk in the direction of the disk center, the opening of this groove at the circumference of the disk corresponding essentially to the size of the locking element engageable in the groove, and that the locking element is guided along a path directed towards the center of the locking disk.

An essential feature of the invention is the groove extending from the circumference of the disk in the direction of the disk center, wherein the direction of the groove may extend not only essentially at right angles to the tangent of the disk circumference but may also form an acute angle in relation thereto. It is, however, important that the groove opens towards the circumference of the disk only to the extent necessary for an interference-free insertion of the locking element. The opening of the groove at the disk circumference will, so that conditions which are as defined as possible are ensured for the engagement or the pivoting of the carriage, have at the most double the width of the dimension of the locking element engaging in the groove.

The clearance between the locking element and the opening of the groove at the disk circumference is preferably kept even smaller in that the opening is, for example, less than 1.5 times the size of the engageable locking element.

The path, on which the locking element is guided when it engages in the locking disk groove, is also important in conjunction with the present invention. The definition of a path directed towards the center of the locking disk does not mean an exact alignment of the path in radial direction towards the central point of the locking disk but a path which leads away from the circumferential direction of the locking disk and can, by all means, also extend at an acute angle, for example 30°, to the tangent of the locking disk circumference. Furthermore, the path need not be a straight line.

The locking element is preferably arranged on a pivotally held locking bar, the distance of the locking element from the pivot axle of the locking bar corresponding essentially to the distance of the pivot axle of the locking bar to the central point of the locking disk. This means that the path, on which the locking element is guided when engaging in the groove of the locking disk, represents a partial circular movement, the circular line of which extends through the central point of the locking disk.

The groove is preferably equipped with essentially parallel side faces which facilitate a simple sliding of the locking element into the groove but, on the other hand, do not leave too great a clearance between locking element and side faces of the groove.

The locking element itself will often have the shape of an elongated detent, which is similar in its shape to a segment of a circular arc. This segment of a circular arc is then arranged parallel to the pivoting direction of the pivot bar and enters the groove of the locking disk with its end face.

In a preferred embodiment, the locking element is held out of engagement with the groove of the locking disk by spring force, preferably by means of a leg spring. When the carriage is pivoted out of its working position, the locking element is then inserted into the groove of the locking disk contrary to the spring force.

The locking element is preferably actuated by an actuating element secured to the carriage base and this actuating element presses on the locking element or rather the detent of the pivot bar when the carriage is pivoted out of its working position and causes the locking element to dip or engage in the groove of the locking disk almost at right angles.

When the locking element or rather detent is engaged in the groove of the locking disk, the adjusting device of the stop plate is locked, i.e. any adjustment of the slice thickness and any exposure of the edge of the cutting knife is thus made impossible.

The aforementioned actuating element which is coupled to the base of the carriage and converts the swivel movement of the carriage into a pivoting movement of the locking bar is preferably articulated to the carriage base on one side and guided in a carriage guide means adjacent to its free end. The actuating element preferably acts directly on the locking element.

In a further, preferred embodiment the locking device comprises a stop bar which extends parallel to the carriage guide means and has at its end corresponding to the displacement end position of the carriage a recess, through which an actuating element coupled with the pivoting movement of the carriage, for example the push rod, can pass for actuating the locking element and act on the locking element. Consequently, the recess is to be arranged in alignment with the locking element and the locking disk.

In order to achieve locking even with very small pivoting movements of the carriage, the outer contour of the locking element and the outer contours of the groove of the locking disk are preferably of a canted design. Canted is to be understood in this case as radii of the interacting edges of locking element and groove of the locking disk which are smaller than 1.0 mm. This means that the locking of the slice thickness adjusting device is effective immediately after commencement of the pivoting away movement of the carriage or rather immediately after commencement of the slice thickness adjustment away from zero.

The cold meat slicing machine is preferably designed such that with a slick thickness setting of greater than "zero" an essentially clearance-free support of the carriage against pivoting movements is ensured by the locking device.

This precludes any pivoting of the carriage slightly out of the working position and any acting in this way of larger forces on the support or the locking device in a pulse-like manner. Moreover, the formation of a larger gap between circular knife and carriage, which would lead to a risk of injury due to contact with the knife, is avoided.

The clearance-free support is preferably formed by the locking element abutting on the circumference of the locking disk and, on the other hand, the actuating element engaging on the locking element or the actuating element abutting on the stop bar in a carriage displaced out of the end position, the actuating element again being held essentially free of clearance on the carriage or rather the carriage base. Minimal gaps between the components in the order of magnitude of 0.5 mm can be tolerated without problem.

In a particularly preferred embodiment of the invention it is provided for the actuating element, in particular, the actuating element, the locking element and the locking disk to be arranged in a common effective plane located at right angles to the axis of rotation of the locking disk in the displacement end position of the carriage. With this arrangement, practically no torsional forces occur and the forces occurring during the pivoting of the carriage or the forces effective in the out-of-operation position due to the force of gravity and the mass of the carriage are absorbed essentially free of torsion by the axis of rotation of the locking disk.

When the carriage pivots back into its working position, the locking of the slice thickness setting is released. In this respect, the locking element or rather the locking bar is pressed out of the locking disk groove by spring force, preferably by means of a leg spring, and comes to rest on a stop which is stationary in relation to the housing in an exact basic position.

During the subsequent cutting stroke movement of the carriage, the actuating element secured to the carriage base and the locking element held on the machine housing remain disengaged but they can be frictionally connected to one another again when the end position of the carriage is reached.

If the operator attempts to pivot the carriage away in its displacement end position with a simultaneous slice thickness setting of greater than zero, i.e. when the cutting edge of the circular knife is unprotected, the carriage will be blocked. The pivoting force exerted on the carriage is directed almost at right angles onto the circumference of the locking disk from the actuating element via the locking element of the locking bar by means of a direct, positive support without the locking bar mounting thereby being subjected to any appreciable load.

Moreover, actuating element, locking element and locking disk are located in an effective plane arranged at right angles to the locking disk axis in order to absorb the pivoting force of the carriage.

In addition, the inventive locking device has further advantages.

The insertion of the locking element (or rather the detent) into the locking disk almost at right angles allows the locking of the disk to become effective immediately after commencement of the pivoting movement of the carriage, i.e. no intermediate positions with an unprotected knife cutting edge are possible.

In a preferred embodiment, the actuating element also dips into the groove of the stop bar simultaneously with commencement of the pivoting movement of the carriage out of its working position and blocks the cutting stroke movement of the carriage out of its displacement end position. It is thereby ensured that the carriage can be pivoted away only in its displacement end position, provided that the stop plate is in the zero position, in which the cutting edge of the circular knife is protected all around against contact.

These and additional advantages of the invention are described in greater detail in the following on the basis of the description and the drawings. In the individual drawings.

Figure 1:
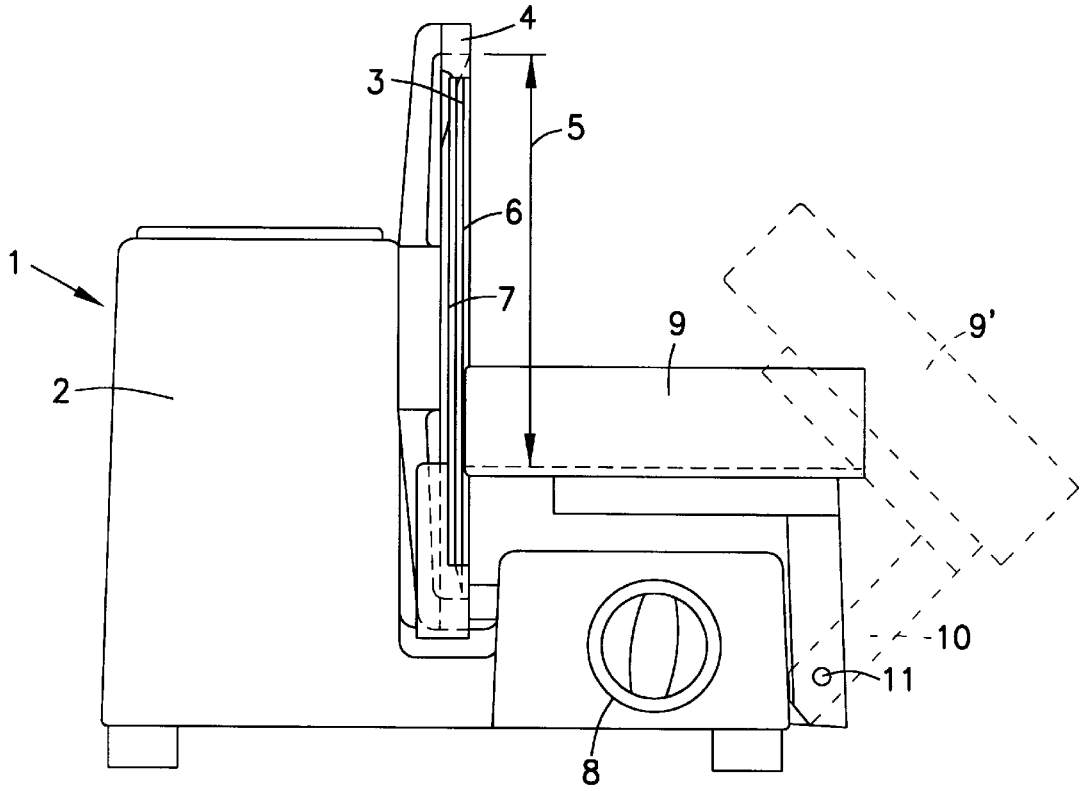
FIG. 1 shows a front view of an inventive slicing machine.

The slicing machine 1 for foods, e.g. sausage, cheese, fish or the like, illustrated in FIG. 1 comprises a machine housing 2, on which a circular knife 3 driven by a motor is rotatably mounted. A knife protection ring 4 in the shape of a spoked wheel is stationarily secured to the machine housing 2 and encloses the cutting edge of the circular knife 3 in a ring-shaped manner for safety reasons, with the exception of the front cutting area 5. A stop plate 7 extending parallel to the cutting plane 6 of the circular knife 3 is arranged in the cutting area 5 for the purpose of setting the slice thickness relative to the knife or rather cutting plane by means of a slice thickness adjusting device 8. The slice thickness adjusting device 8, which is known per se, can be set in its minimum setting to a slice thickness "below zero" (for example, approximately −0.5 to −2 mm). In this position, the front edge of the stop plate 7 covers the cutting edge of the circular knife 3 in the front cutting area 5 and, together with the knife protection ring 4, results in a contact protection over the complete circumference of the circular knife 3.

A carriage 9 for receiving a product to be cut which is not illustrated can be reciprocated along the circular knife 3, parallel to the knife or rather cutting plane. The product to be cut is fed to the rotating circular knife 3 lying on the carriage 9 and cut into slices abutting on the stop plate 7.

The cutting plane 6 of the circular knife 3 can be arranged at right angles to the installation surface of the slicing machine 1, as illustrated in FIG. 1, or be inclined at a predetermined angle in relation to the vertical (inclined slicer).

The carriage 9 can be pivoted away from the circular knife 3 about a pivot axle 11 mounted on the carriage base 10, out of its working position illustrated in FIG. 1 into the cleaning position 91 illustrated by dash-dot lines.

Figure 2:
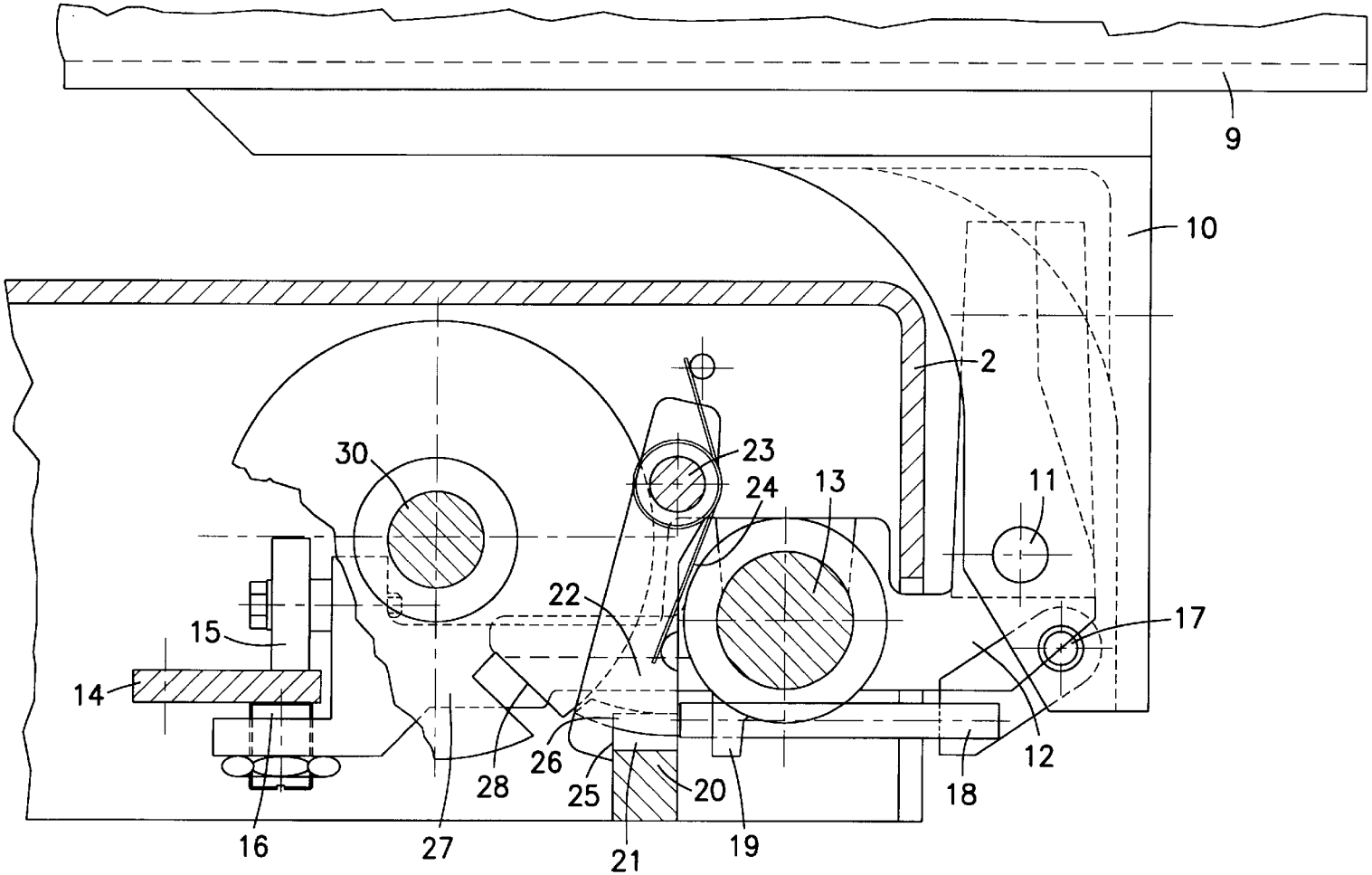
FIG. 2 shows a partial section at right angles to the carriage cutting stroke movement with carriage in working position.

It is apparent from FIG. 2 that the carriage base 10 is articulatedly connected to a carriage guide means 12 which is guided for sliding displacement at right angles to the plane of the drawing on a guide axle 13 rigidly secured to the machine housing 2 and is secured against rotation by means of a guide rail 14 likewise rigidly secured to the machine housing 2 between a roller 15 and a threaded pin 16.

A push-rod axle 17 is arranged on the carriage base 10 parallel to the pivot axle 11, an actuating element 18 in the shape of a push rod being articulatedly attached to this axle. This actuating element is mounted at the same time in a guide bore 19 of the carriage guide means 12 for displacement at right angles to the push-rod axle 17. The end of the actuating element 18 slides along a stop bar 20 secured to the machine housing 2 during the cutting stroke movement of the carriage 9. This stop bar has a recess 21 in its displacement end position, preferably on the side of the slice thickness adjusting device 8.

The actuating element 18 and the stop bar 20 prevent the carriage 9 from pivoting away during the entire cutting stroke movement, with the exception of the one displacement end position, in which the actuating element 18 can dip into the recess 21 of the stop plate 20.

In the one displacement end position of the carriage 9, the actuating element 18 comes into contact with a locking bar 22 which is mounted for rotation on a bolt 23 stationary in relation to the housing. The locking bar 22 is pressed into the recess 21 of the stop bar 20 by spring force, preferably with a leg spring 24, so that the locking bar stop 25 comes to rest and the locking element 26 of the locking bar 22 designed in the shape of a detent is aligned with the oppositely located contact surface of the stop bar 20 and with the end face of the actuating element 18.

If the carriage 9 is now pivoted out of the working position in the one displacement end position, the actuating element 18 presses on the locking element 26. The pivoting movement of the locking bar 22 is, however, blocked by a locking disk 27 which is rigidly connected to the slice thickness adjusting device 8 and rotatable together with this device for as long as the stop plate 7, as illustrated in FIG. 2, is set to a slice thickness greater than zero.

The pivoting force exerted on the carriage 9 is directed by means of a direct, essentially clearance-free support from the push-rod axle 17 via the actuating element 18 and the locking element 26 almost at right angles onto the circumference of the locking disk 27 without the locking bar mounting bolt 23 thereby being subjected to any appreciable load. Also when viewed at right angles to the axle 30 of the locking disk 27 (FIG. 4), actuating element 18, locking element 26 and locking disk 27 are located in one effective plane in order to absorb the pivoting force of the carriage 9.

Figure 3:
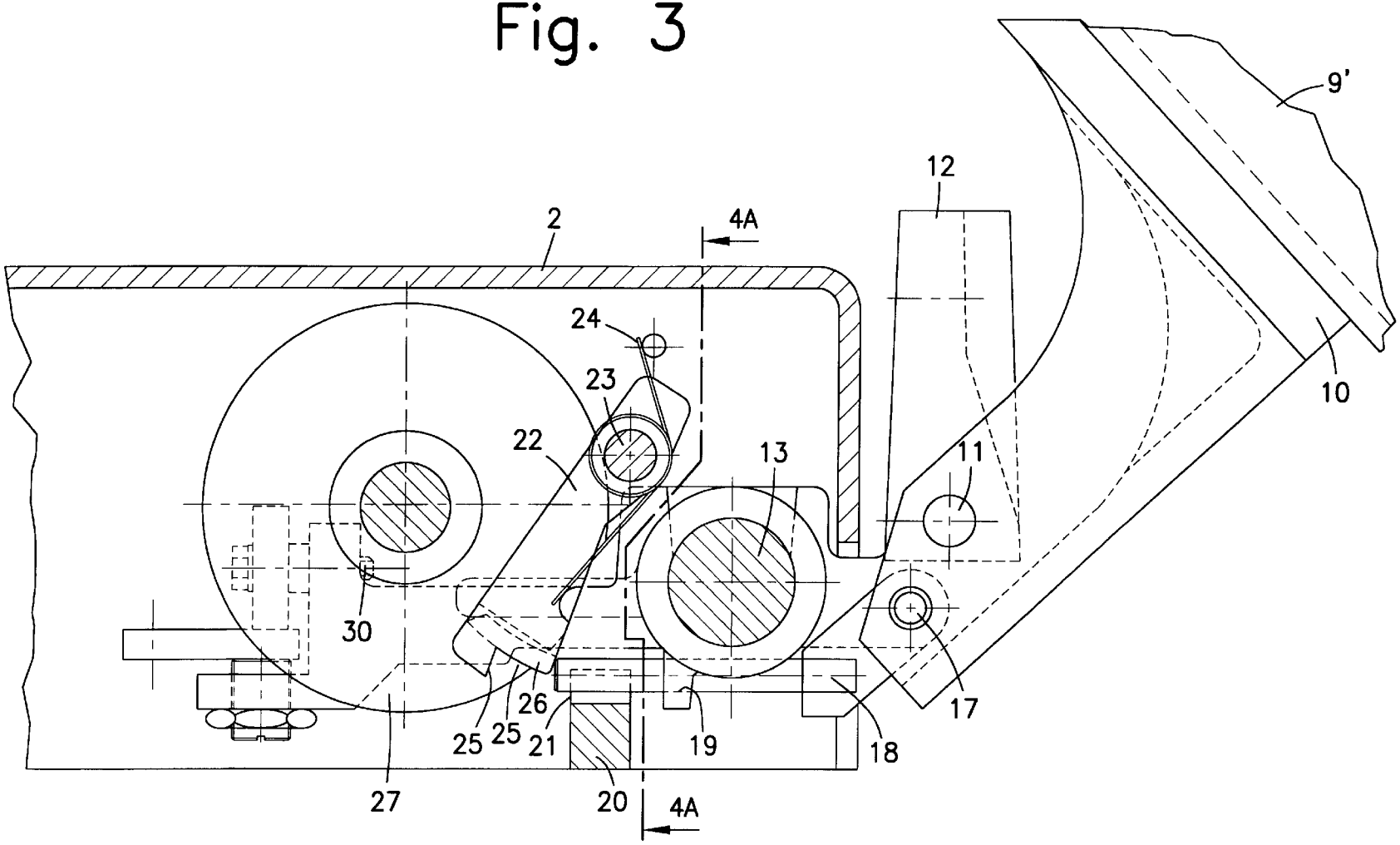
FIG. 3 shows a partial section at right angles to the carriage cutting stroke movement with the pivoted-away position of the carriage (cleaning position)

In FIG. 3, the stop plate 7 is set to its minimum setting "below zero" by means of the slice thickness adjusting device 8. In this setting, the carriage 9 can be pivoted away. This is made possible by a groove 28 which is arranged approximately radially at the circumference of the locking disk 27 and into which the locking element 26 dips almost at right angles. This means that the slice thickness adjusting device rigidly coupled to the locking disk 27 is blocked immediately from the commencement of the pivoting movement of the carriage 9 out of its working position and thus the cutting edge of the circular knife 3 is protected by the end face of the stop plate 7.

Figure 4:
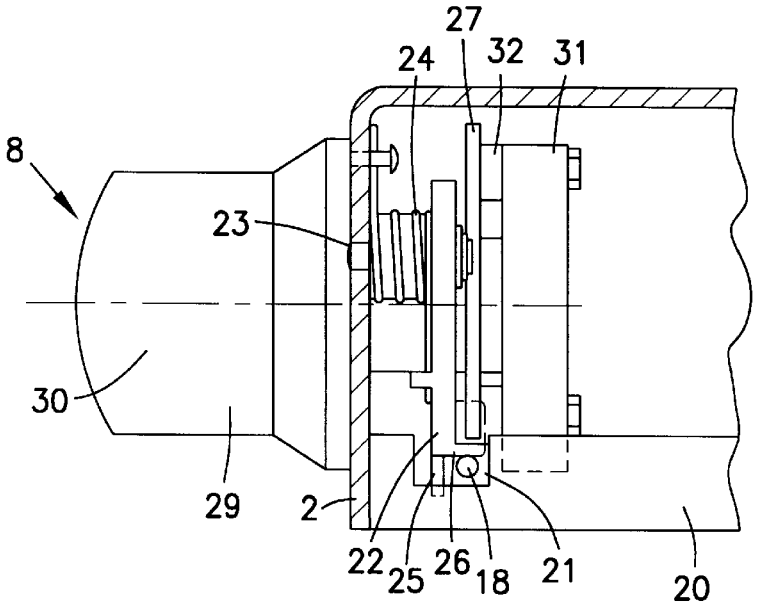
FIG. 4 shows a section 4A—4A according to FIG. 3.

In FIG. 4, the slice thickness adjusting device 8, which is known per se, is partially illustrated. The desired slice thickness is set with a control handle 29. The control handle 29 is rigidly connected with a cam 31 and the locking disk 27, which is attached via a spacer ring 32, via the axle 30 mounted for rotation in the machine housing 2.

The cam 31 is connected in addition with an adjusting device which is not illustrated and which converts the rotary movement of the cam 31 into a translatory movement of the stop plate 7 at right angles to the cutting plane 6 of the circular knife 3.

I claim:

1. A food slicing machine including (i) a machine housing and a disk-shaped knife having a cutting plane and rotatably mounted on said housing;

(ii) a stop plate coupled to said housing and means including a rotatable adjusting device for moving said stop plate relative to the cutting plane of the knife to set the thickness of a slice;

(iii) a guide extending parallel to the cutting plane and a food carriage mounted for reciprocation on said guide between limits;

(iv) said food carriage being pivotable about an axis parallel to the guide between a slice-cutting position and a fully retracted position;

(v) a locking assembly including (a) a locking disk rigidly connected to rotate with said adjusting device and having a center, a periphery and a slot of uniform width extending from the periphery in the direction of the center, (b) a locking element having a width slightly smaller than that of the slot and being disposed closely adjacent said periphery when the carriage is in the slice-cutting position, said locking element mounted for movement along a generally radial path with respect to said locking disk, wherein said generally radial path extends across said periphery and generally toward said center of said locking disk; and (vi) moving means responsive to pivoting of the carriage from the slice-cutting position for moving the locking element in said generally radial path toward said periphery;

(vii) wherein rotation of the adjusting device to produce a slice thickness of zero aligns the slot with the locking element, and wherein a relatively small amount of pivoting of the carriage from the slice-cutting position toward the fully retracted position causes the locking element to move along said generally radial path and enter the slot preventing substantial rotation of the adjusting device in either direction.

2. The machine of claim 1, further including a locking bar connected to said locking element and pivotable about an axis, wherein the distance between said axis and the locking element is substantially equal to the distance between said axis and the center of the locking disk.

3. The machine of claim 1, additionally including a spring biasing said locking element away from said periphery.

4. The machine of claim 1, wherein said locking assembly further includes a stop bar disposed parallel to the guide and having an aperture aligned with said locking element, wherein said moving means includes an actuator connected to the carriage, and wherein the actuator is aligned with the aperture to pass through the aperture and move the locking element into said slot at one of said limits of said carriage reciprocation.

5. The machine of claim 4, wherein said carriage is locked at said one limit upon passage of said actuator into the aperture.

6. The machine of claim 4, further including:

a stop connected to said locking element, and a spring biasing said locking element away from said periphery to a position closely adjacent said periphery at which said stop contacts said stop bar.

7. The machine of claim 1, wherein said moving means comprises an articulated actuator aligned with said locking element to directly contact and move said locking element.

8. The machine of claim 7, wherein rotation of the adjusting device to produce a slice thickness greater than zero causes the locking element to become aligned with portions of said periphery which do not include the slot, wherein a small amount of pivoting of the carriage from the slice-cutting position causes the locking element to engage said periphery and prevent further pivoting of the carriage.

9. The machine of claim 1, wherein said locking element, said moving means and said locking disk are disposed in a common plane at one of said limits of said carriage reciprocation.

10. The machine of claim 9, wherein said locking disk rotates about an axis orthogonal to said common plane.

11. The machine of claim 1, wherein the slot is canted at an angle relative to a tangent to the periphery of the locking disk intersecting said slot, wherein the angle of the slot lies in the range between approximately 90° and approximately 30° to said tangent.

12. The machine of claim 1, wherein each region where the slot meets the periphery forms an edge.

13. The machine of claim 1, wherein the locking element has an end face with a width corresponding in extent to the width of the slot, said end face being terminated in at least one edge.

* * * * *

UNITED STATES PATENT AND TRADEMARK OFFICE

CERTIFICATE OF CORRECTION

PATENT NO. : 6,016,734
DATED : January 25, 2000
INVENTOR(S) : KLAUS KOCH

It is certified that error appears in the above-indentified patent and that said Letters Patent is hereby corrected as shown below:

Add the following assignee data:

--[73] Assignee: Bizerba GmbH & Co. KG,
Balingen, Germany

Signed and Sealed this

Fifteenth Day of May, 2001

*Attest:*

Nicholas P. Godici

NICHOLAS P. GODICI

*Attesting Officer*

*Acting Director of the United States Patent and Trademark Office*